United States Patent [19]

Stubbings

[11] 4,170,910

[45] Oct. 16, 1979

[54] ANGLE IRON CUTTING

[75] Inventor: James H. Stubbings, Rockville, Md.

[73] Assignee: Potomac Applied Mechanics, Inc., Bethesda, Md.

[21] Appl. No.: 846,216

[22] Filed: Oct. 27, 1977

Related U.S. Application Data

[62] Division of Ser. No. 795,088, May 9, 1977, Pat. No. 4,106,380.

[51] Int. Cl.[2] ..... B26D 11/00

[52] U.S. Cl. ..... 83/71; 83/212; 83/405; 83/444; 83/549; 83/552

[58] Field of Search ..... 83/40, 71, 157, 212, 83/281, 405, 549–553, 444

[56] References Cited

U.S. PATENT DOCUMENTS

| | | | |
|---|---|---|---|
| 1,482,350 | 1/1924 | Dayton | 83/552 X |
| 2,072,667 | 3/1937 | Coe | 214/8.5 F |
| 3,498,167 | 3/1970 | Hill | 83/255 X |
| 3,602,378 | 8/1971 | Thompson | 214/8.5 F |

*Primary Examiner*—J. M. Meister

*Attorney, Agent, or Firm*—Cushman, Darby & Cushman

[57] ABSTRACT

Apparatus for providing a supply of angle irons or like elongated members. A dispensing magazine includes a pair of side walls and a bottom wall, the magazine being pivotal about a horizontal axis for movement from a first operating position where the walls are generally vertical to a second loading position where the walls are generally horizontal. The angle irons in the vertical stack with the side walls in the first position are moved upwardly as the top angle iron is removed, so that the top angle iron in the vertical stack is always substantially at the same vertical level. An ejecting cylinder or the like is provided for pushing the top angle iron from the vertical stack off of the stack when the magazine is in the first position.

6 Claims, 3 Drawing Figures

ANGLE IRON CUTTING

This is a division of application Ser. No. 795,088 filed May 9, 1977, now U.S. Pat. No. 4,106,380.

BACKGROUND AND SUMMARY OF THE INVENTION

The invention relates to a magazine for providing a supply of and dispensing angle iron or the like. The term "angle irons" as used in the ensuing specification and claims is intended to mean angle irons, rails and like elongated plane-surface construction members (which may be bent into tubes after cutting and punching).

The invention relates to apparatus for providing a supply of angle irons which minimizes the floor space that is required, and can provide for automatic feed of the angle irons to automatic or manual structures for acting thereon (such as shown in parent application Ser. No. 795,088 filed May 9, 1977, and in U.S. Pat. No. 3,498,167). The apparatus according to the invention includes a magazine with a pair of side walls and a bottom wall, and means for pivotally mounting the magazine from a first operating position (wherein the side walls are generally vertical and a vertical stack of angle irons is provided), to a second loading position (wherein the side walls are generally horizontal). Also, means are provided for moving the angle irons upwardly so that the top angle iron in the vertical stack is always substantially at the same vertical level as the angle irons are removed from the top of the stack one by one. Such upwardly moving means may comprise at least one linearly reciprocal arm and spring means in operative engagement with the arm for biasing the arm upwardly when the magazine is in the first position thereof. Power means may be provided for pivoting the magazine about the pivotal mount thereof, and an ejection cylinder or like means is provided for pushing the top angle iron from the vertical stack off of the stack when the magazine is disposed in its first position.

When utilizing the magazine according to the present invention, one merely moves the magazine to the second, loading position, whereby easy loading of the magazine may be effected, and then moves it to the first, operating position whereat the angle irons are provided in a vertical stack. This saves floor space while still allowing ready loading of the magazine with the angle irons, which angle irons may be difficult to manually load if the magazine remains in a vertical position.

It is the primary object of the present invention to provide improved apparatus for providing a supply of angle irons and/or dispensing them one by one. This and other objects of the invention will become clear from an inspection of the detailed description of the invention and from the appended claims.

DETAILED DESCRIPTION OF THE INVENTION

Figure 1:
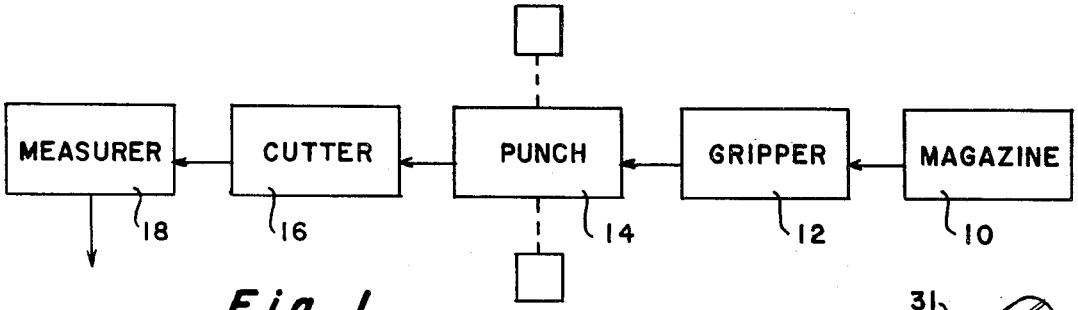
FIG. 1 is a schematic showing the magazine according to the present invention in use with an exemplary assembly for acting on the angle irons dispensed by the magazine.

Exemplary apparatus for automatically acting on angle irons or the like being dispensed by the magazine 10 according to the present invention is shown diagrammatically in FIG. 1. Such apparatus generally includes the means for providing a supply of angle irons, a magazine 10 according to the present invention, means 12 for transporting the angle irons away from the supply means 10, means 14 for punching holes of predetermined size in an angle iron at a punching position, means 18 for automatically determining the length of the angle iron to be cut at a cutting position, and means 16 for cutting an angle iron at the cutting position. Exemplary dimensions that the various components could take are 20 feet for the magazine 10, 20 feet for the transporting means 12, 36 inches for the punching means 14, 24 inches for the cutting means 16, and 20 feet for the measuring assembly 18.

Figure 2:
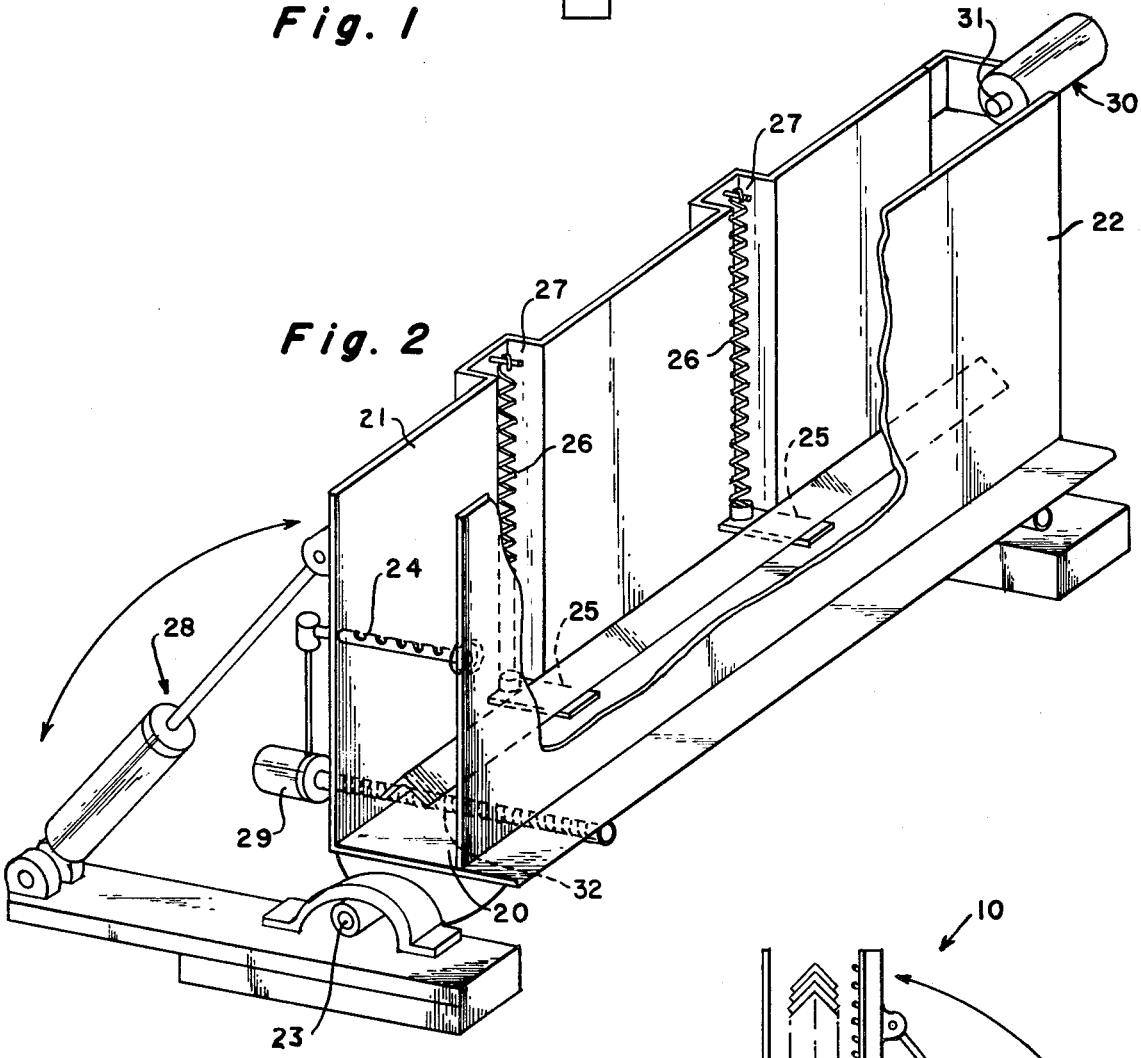
FIG. 2 is a schematic perspective view, with portions cut-away for clarity, of an exemplary magazine according to the invention.
Figure 3:
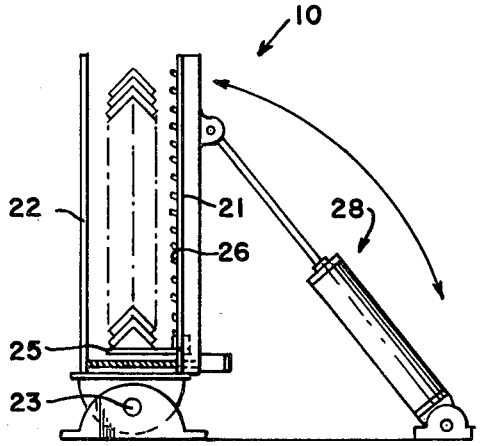
FIG. 3 is an end view of the magazine of FIG. 2.

The magazine 10, according to the present invention as shown most clearly in FIGS. 2 and 3, comprises means for providing a vertical stack of angle iron D. The magazine includes a bottom 20, first and second sides 21 and 22, respectively, and pivotal mounting means 23 for mounting the magazine so that it is pivotal from a first position (shown in FIG. 3) wherein the sides 21 and 22 are generally vertical and a vertical stack of angle irons D is provided to a second loading position wherein the sides 21, 22 are generally horizontal. Means are provided for biasing the angle irons D upwardly in the stack so that the top angle iron in the stack is always at generally the same vertical position, said means including one or more supporting arms 25 and a coil spring or the like 26 in operative engagement with each arm 25 and for biasing the arm 25 upwardly. Such means move the angle irons upwardly so that as angle irons are consecutively moved off of the top of the stack they are replaced, the top angle iron in the vertical stack always being at the same general vertical level. A groove 27 may be provided in wall 21 for each arm 25 to guide the movement of the arm 25. Power means, such as an air or hydraulic cylinder 28, may be provided for pivoting the magazine 10 about the pivot 23 from the vertical position shown to a horizontal loading position.

Adjustment means, such as motor 29 for rotation of screw rod 32 and ratchet detent 24, can be provided for adjusting the spacing between the walls 21,22 to accommodate angle irons D of different dimensions.

A stationary ram 30 or the like, having an angle engaging proportion 31 thereof, is provided for moving the top angle iron off of the stack so that it may be acted on by the transporting means 12. The means 30 feeds the angle irons one at a time to the transporting means 12 by pushing the top angle iron off of the vertical stack until an end thereof is spaced from the stack, at which point the spaced end may be engaged by the transporting means 12 and moved by the transporting means 12 off of the stack. Under the influence of springs 26, when one angle iron is moved off the stack, the next angle iron comes up to the vertical position where it cooperates with the ram 30.

Various accessory devices may also be provided with the magazine 10. For instance, some sort of a detent means may be used for separating the top angle iron of the stack from the next angle iron for facilitating engagement thereof by the ram portion 31 and an automatic sensor may be provided for sensing the position of the arm 25 to determine when the magazine is empty to thereby actuate the cylinder 28 and facilitate reloading of the magazine. Other modifications are also possible. It is noted that the magazine according to the present invention takes up a minimum of floor space compared to horizontal positioning of angle irons for feeding, and provides for positive feeding of each angle iron into proper position for further treatment thereof.

The transporting means 12 engages a spaced end of the top angle iron in the vertical stack and then transports the angle iron off the stack to the punching means 14. The means 12, 14, 16, and 18 may be as described in parent application Ser. No. 795,088 filed May 9, 1977, or as provided in the U.S. Pat. No. 3,498,167, or a similar arrangement.

An exemplary operation of the structure according to the invention will now be set forth: the cylinder 28 is activated to move the magazine 10 to a generally vertical position and a plurality of angle irons D are inserted into the magazine 10, depressing the arms 25 as they are inserted. Once a desired number of angle irons are provided in the magazine 10, the cylinder 28 is again activated to move the magazine to a generally vertical position as shown in FIG. 3.

Once the magazine 10 is in its vertical position, the ram 31 is actuated to push one end of the top angle iron D slightly off of the stack. The free end is engaged by the gripper assembly 12, and afterwards the angle iron is passed on to the punching, cutting, and measuring stations 14, 16 and 18 respectively. After the angle iron has cleared the gripper 12, the ram 31 is again activated to push the next angle iron off of the top of the vertical stack in magazine 10, such next angle iron having been moved into place by the moving means (i.e., 26, 25) so that it is at the same vertical level (even with the ram 31) as the previous angle iron on the top of the stack.

While the invention has herein been shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed:

1. Apparatus for automatic punching and cutting of angle irons or the like comprising:

means for providing a supply of angle irons to be cut;

means for transporting said angle irons away from said supply means;

means for punching holes of predetermined size in an angle iron at a punching position, said means comprising a plurality of male dies, each of a different size, means for selecting one of said plurality of male dies for punching a hole in an angle iron at said punching position and power means for moving a selected male die to effect punching, a plurality of female dies for cooperation with said male dies, one corresponding to each of said male dies in size to effect punching of a hole in an angle iron of desired size and selecting means for automatically selecting the proper one of said plurality of female dies for cooperation with a selected male die, said selecting means comprising shaft rotatable about a horizontal axis having a plurality of arms: each arm having a female die associated therewith, a guide slot for receiving a face of an angle iron which face is not acted upon by a said male die, and a blank disposal slot allowing passage of blanks out of said arm; and power means for indexed rotation of said shaft to move the selected female die arm into cooperative position with a male die;

means for automatically determining the length of angle iron to be cut at a cutting position; and means for cutting an angle iron at the cutting position to provide an angle iron of predetermined length.

2. Apparatus as recited in claim 1 wherein said plurality of male dies are mounted in a common block, each die being spring-biased so that it is normally generally contained in said block, but movable against its spring bias by said power means out of containment within said block.

3. Apparatus as recited in claim 2 wherein said means for automatically selecting one of said plurality of male dies comprises means for linearly reciprocating said block to bring a selected die into cooperative position with said power means, said power means remaining stationary with respect to said block.

4. Apparatus for automatic punching and cutting of angle irons or the like comprising:

means for providing a supply of angle irons to be cut;

means for transporting said angle irons away from said supply means;

means for punching holes of predetermined size in an angle iron at a punching position, said means comprising a plurality of male dies, each of a different size, means for selecting one of said plurality of male dies for punching a hole in an angle iron at said punching position and power means for moving a selected male die to effect punching, a plurality of female dies for cooperation with said male dies, one corresponding to each of said male dies in size to effect punching of a hole in an angle iron of desired size and selecting means for automatically selecting the proper one of said plurality of female dies for cooperation with a selected male die, said selecting means comprising a shaft rotatable about a horizontal axis having a plurality of arms, each arm having a female die associated therewith and power means for indexed rotation of said shaft to move the selected female die arm into cooperative position with a male die;

said plurality of male dies being mounted in a common block, each die being spring-biased so that it is normally generally contained in said block, but movable against its spring bias by said power means out of containment within said block, and said means for automatically selecting one of said plurality of male dies comprising means for linearly reciprocating said block to bring a selected die into cooperative position with said power means, said power means remaining stationary with respect to said block;

means for automatically determining the length of angle iron to be cut at a cutting position; and means for cutting an angle iron at the cutting position to provide an angle iron or predetermined length.

5. Apparatus as recited in claim 4 wherein said block reciprocating means comprises a rotatable lead screw, a travelling nut collar for receipt thereof, a guide rod, and a guide collar for receipt of said guide rod.

6. A method for acting on angle irons or the like comprising the steps of:

providing a vertical stack of a plurality of angle irons and substantially continuously automatically feeding the angle irons one at a time to a punching position;

punching a hole in the face of the angle iron at the punching position;

feeding the angle iron from the punching position to a cutting position in a linear direction of movement;

automatically selectively determining the length of angle iron to be cut at the cutting position;

cutting the angle iron at the cutting position to provide an angle iron of a given length;

removing each cut angle iron from the cutting position; and automatically selecting from a number of possible sizes the size hole to be punched in the face of each angle iron at the punching position, by rotating a female die member about a horizontal axis into operative relationship with the respective face of the angle iron, and moving a male die into operative relationship with the female die member, the male die and the female die member selected having the same effective size so that they effect punching of a hole of desired size.

* * * * *